US009302191B2

(12) United States Patent
Robustelli et al.

(10) Patent No.: US 9,302,191 B2
(45) Date of Patent: Apr. 5, 2016

(54) YO-YO TOY

(75) Inventors: Urs Robustelli, Zurich (CH); Gregor Altenburger, Zurich (CH)

(73) Assignee: LIMMAT PRODUKT GMBH, Zurich (CH)

( * ) Notice: Subject to any disclaimer, the term of this patent is extended or adjusted under 35 U.S.C. 154(b) by 0 days.

(21) Appl. No.: 14/406,354

(22) PCT Filed: Jun. 7, 2012

(86) PCT No.: PCT/CH2012/000128
§ 371 (c)(1),
(2), (4) Date: Dec. 8, 2014

(87) PCT Pub. No.: WO2013/181764
PCT Pub. Date: Dec. 12, 2013

(65) Prior Publication Data

US 2015/0140894 A1 May 21, 2015

(51) Int. Cl.
*A63H 1/30* (2006.01)
*A63H 1/06* (2006.01)
*A63H 29/24* (2006.01)

(52) U.S. Cl.
CPC .. *A63H 1/06* (2013.01); *A63H 1/30* (2013.01); *A63H 29/24* (2013.01)

(58) Field of Classification Search
USPC ..... 446/235, 245, 247, 248, 250, 251; 33/767
See application file for complete search history.

(56) References Cited

U.S. PATENT DOCUMENTS

| | | | | |
|---|---|---|---|---|
| 617,665 | A | 1/1899 | Waterhouse | |
| 942,952 | A * | 12/1909 | Whather | 446/235 |
| 999,247 | A | 8/1911 | O'Byrne | |
| 2,605,584 | A * | 8/1952 | Perker et al. | 446/250 |
| 2,610,439 | A * | 9/1952 | Nemeth | 446/250 |
| 2,666,276 | A | 1/1954 | Huff | |
| 3,362,101 | A * | 1/1968 | Grow | 446/249 |
| 3,724,121 | A * | 4/1973 | Atkins et al. | 446/250 |
| 4,418,494 | A | 12/1983 | Ghandour | |
| 4,601,474 | A * | 7/1986 | Lew et al. | 473/576 |
| 4,663,854 | A * | 5/1987 | Miller et al. | 33/767 |
| 5,127,868 | A * | 7/1992 | Smollar | 446/250 |
| 5,794,357 | A * | 8/1998 | Gilliam et al. | 33/767 |
| 5,806,202 | A * | 9/1998 | Blackman et al. | 33/767 |
| 5,947,790 | A * | 9/1999 | Gordon | 446/247 |
| 6,123,597 | A * | 9/2000 | Matthews et al. | 446/250 |
| 6,247,992 | B1 * | 6/2001 | Higgins, III | 446/250 |
| 6,308,432 | B1 * | 10/2001 | Gilliam et al. | 33/767 |
| 6,405,451 | B1 * | 6/2002 | Hsu | 33/767 |
| 6,595,451 | B1 * | 7/2003 | Kang et al. | 242/381.2 |
| 6,705,163 | B1 * | 3/2004 | Lattner et al. | 73/309 |

(Continued)

FOREIGN PATENT DOCUMENTS

CN 201643680 11/2010

OTHER PUBLICATIONS

International Search Report for PCT/CH2012/000128, English translation attached to original, Both completed by the European Patent Office on Dec. 19, 2012, All together 7 Pages.

*Primary Examiner* — Kurt Fernstrom
(74) *Attorney, Agent, or Firm* — Brooks Kushman P.C.

(57) ABSTRACT

A yo-yo toy that is assembled from hemispheres into which the yo-yo is inserted together with the axle thereof. Holding elements for retaining the string during the free running of the yo-yo are provided at the outlet opening for the string of the yo-yo.

14 Claims, 18 Drawing Sheets

(56) References Cited

U.S. PATENT DOCUMENTS 7,059,932 B1 * 6/2006 Tobias et al. ..... 446/250
7,398,604 B2 * 7/2008 Murray ..... 33/767
8,556,675 B2 * 10/2013 Gonzalez ..... 446/220
2012/0318212 A1 * 12/2012 Montenegro ..... 119/792

* cited by examiner

Fig. 18
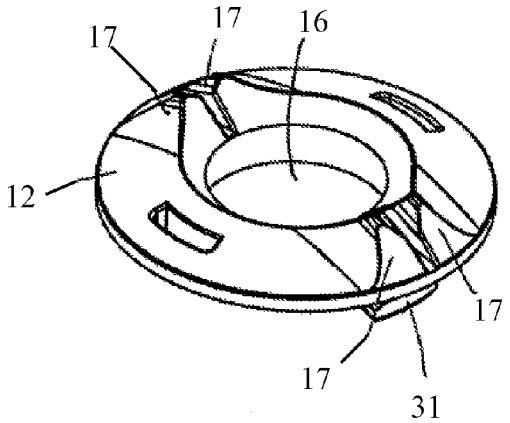
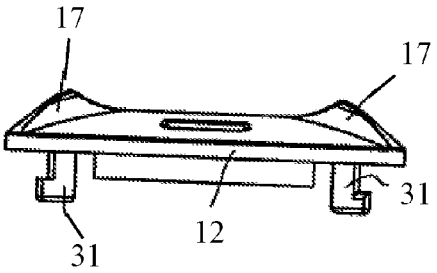
Fig. 19
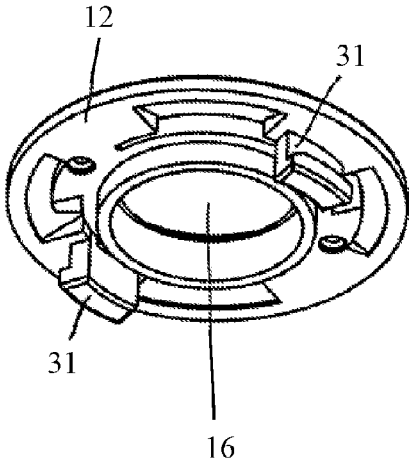
Fig. 20

YO-YO TOY

CROSS-REFERENCE TO RELATED APPLICATION

This application is the U.S. national phase of PCT Application No. PCT/CH2012/000128 filed on Jun. 7, 2012, the disclosure of which is incorporated in its entirety by reference herein.

FIELD OF THE INVENTION

The invention relates to a yo-yo toy comprising a yo-yo with a freewheel and a housing which surrounds the yo-yo and in which the rotational axle of the yo-yo is mounted, the housing having an outlet opening for the yo-yo string on its upper side.

PRIOR ART

Yo-yos are known which have a freewheel. The latter allows it to be possible for the yo-yo to rotate with a tensioned string, without the string being wound up. The string can be wound up again by the rotating yo-yo only after a brief relief of the string, with the result that it is no longer tensioned. The freewheel can be brought about by way of a simple string loop which is laid around the yo-yo axle or, as is customary nowadays, by way of what is known as a "transaxle" design.

SUMMARY OF THE INVENTION

It is an aim of the invention to produce a yo-yo toy which can provide improved and extended play options; in particular, a yo-yo toy which makes it possible to juggle, balance or spin with the yo-yo ball during the freewheeling operation, and also to hold the yo-yo ball during the freewheeling operation.

This aim is achieved by way of the yo-yo toy which is mentioned at the outset having the features of claim 1.

The fixing element allows the string to be fixed under tension, with the result that the player does not have to hold it under tension, in order to keep the freewheel active. Here, a freewheel is understood to mean any construction of the yo-yo which makes it possible for the latter to rotate further when the string is tensioned. In this way, the player can use the hand which is otherwise utilized to maintain the string tension for game variants. The yo-yo toy allows spinning, balancing and classic yo-yo play using one hand (regardless of right-handedness or left-handedness) and with or without a finger loop.

In order to maintain the freewheeling operation, without it being necessary for the string to be held further, the fixing element can be configured in such a way that the string can preferably be clamped into a holding depression between two adjacent shaped-out formations, or that the string can be wrapped around a shaped-out formation, in particular can be wrapped around a type of bollard. However, the depression of the fixing element for clamping the string can also be provided directly in the housing, in particular in a cap-shaped part of the housing, without shaped-out formations protruding beyond the housing. More than one fixing element of this type is preferably provided and they are provided such that they are arranged around the string opening in the housing of the yo-yo.

It is a further aim of the present invention for it to be possible to play the yo-yo ball even without a finger loop. Therefore, a holding element is preferably provided instead of the finger loop at the end of the string outside the housing, which holding element can be, for example, spherical or can be of mushroom-shaped configuration in the broadest sense, and which holding element can assume the holding function for the string in the hand. The holding element can preferably be sunk into the housing. Thanks to said holding element, the holding position can be changed constantly even during play. In addition, said holding element can also be caught again satisfactorily during juggling of the yo-yo during the freewheeling operation, and a transition can therefore be made immediately again to actual yo-yo play.

In order to achieve the aim that the string can be set simply to the size of the player, there can be a storage space, in particular with a winding bobbin, in the interior of the holding element, in particular in the form of a holding ball, onto which winding bobbin the string can be wound to the desired length and can be fixed. In order for it to be possible to access this function, the holding element or the holding ball can consist of two parts and can be capable of being opened and closed by means of a closure. As mentioned, another shape for the holding element instead of a ball is also possible.

In order to achieve the aim that the string does not rotate so readily, the string is fixed in the holding element in such a way that it can rotate readily in the latter.

In addition, it is an aim of the invention that the string cannot be wound completely into the inner part of the yo-yo. In order that this cannot take place, the holding element is larger than the outlet opening for the string in the housing, which outlet opening is centered with respect to the axle center.

In order to achieve the aim that the housing of the yo-yo can be opened, in order that the string can be changed, the axle can be cleaned, etc., the housing consists of two main parts which are held together by means of fastening elements. The housing is preferably spherical. The fastening elements are then preferably provided in the form of spherical caps at the poles and at two equatorial points of the ball which lie opposite one another.

In order to achieve the aim that the axle and the yo-yo can be removed from the housing, the yo-yo and its bearings are mounted on an axle, the bearings making the rotation of the axle relative to the housing possible. They can be removed from the yo-yo housing hemispheres and can be inserted into them again.

In order to achieve the aim that the actual yo-yo can be set individually, the yo-yo axle has both a stop for one half of the yo-yo and the option for adjustment.

It is a further aim of the invention that the yo-yo function can be balanced in an improved and easier manner. This is achieved by way of the outlet opening for the string, which outlet opening is centered with respect to the axle center of the yo-yo, by way of the preferred spherical shape and by way of the mountings which lie remote from the actual yo-yo part as a result of the extended axle. Instead of a round opening in the housing, a centered gap can also serve as outlet opening, since the latter can additionally serve the purpose of guiding the string toward the axle and the yo-yo disks in an optimum manner.

In order to achieve the aim that the string which is unwound from the yo-yo can be wound up again easily, the axle which leads through the yo-yo is connected to a cap which freewheels with respect to the yo-yo ball. If said cap is rotated, the axle rotates and the string is wound up.

It is an additional aim of the invention that the rotation of the yo-yo in the freewheeling operation can be utilized as a spinning function. For this purpose, there is a shaped-out formation or lug, as known from gyroscopes, on the cap which is connected to the axle, in order that an excessive amount of friction is not developed during spinning and the yo-yo toy can be balanced satisfactorily again in the spinning function.

It is a further aim of the invention that the rotation of the yo-yo in the freewheeling operation can be utilized to balance the yo-yo toy on the body of the player and on objects, specifically also, for example, on a ballpoint pen or a string. For this purpose, a cap which lies in the continuation of the axle is not connected to the latter and additionally has both a depression and preferably a string guide for the purpose of balancing.

In addition, it is an aim of the invention that the yo-yo ball can be held directly in the hand during the freewheeling operation and also for direct unwinding of the yo-yo, and also that the yo-yo can be touched and moved by the body or objects in every play situation, without the rotation of the yo-yo being impeded. In order to achieve this, the actual yo-yo is installed into a ball and the axle of the yo-yo leads through bearings (plain bearings or anti-friction bearings) which are fixed in mountings in the inner edge of the ball.

It is a further aim of the invention that the string which is fixed during the freewheeling operation can be laid around the yo-yo ball as a play variant and afterward can be rolled up again by way of a tug and can be returned into the actual yo-yo function. For this purpose, string guides are situated on the underside of the yo-yo ball. Said string guides can also be used for further string tricks, as can possible additional guide depressions around the yo-yo ball.

BRIEF DESCRIPTION OF THE DRAWINGS

The stated and further aims are achieved by way of the features which are specified in the claims. These and further aims and advantages of the invention can be seen from the following description and the drawings, in which:

FIG. 18 shows a perspective view of one preferred embodiment of the upper cap according to the toy from FIG. 2 obliquely from above, FIG. 19 shows the cap from FIG. 18 in a side view, and FIG. 20 shows the cap from FIG. 18 in a perspective view from below.

WAYS OF IMPLEMENTING THE INVENTION

Figure 1:
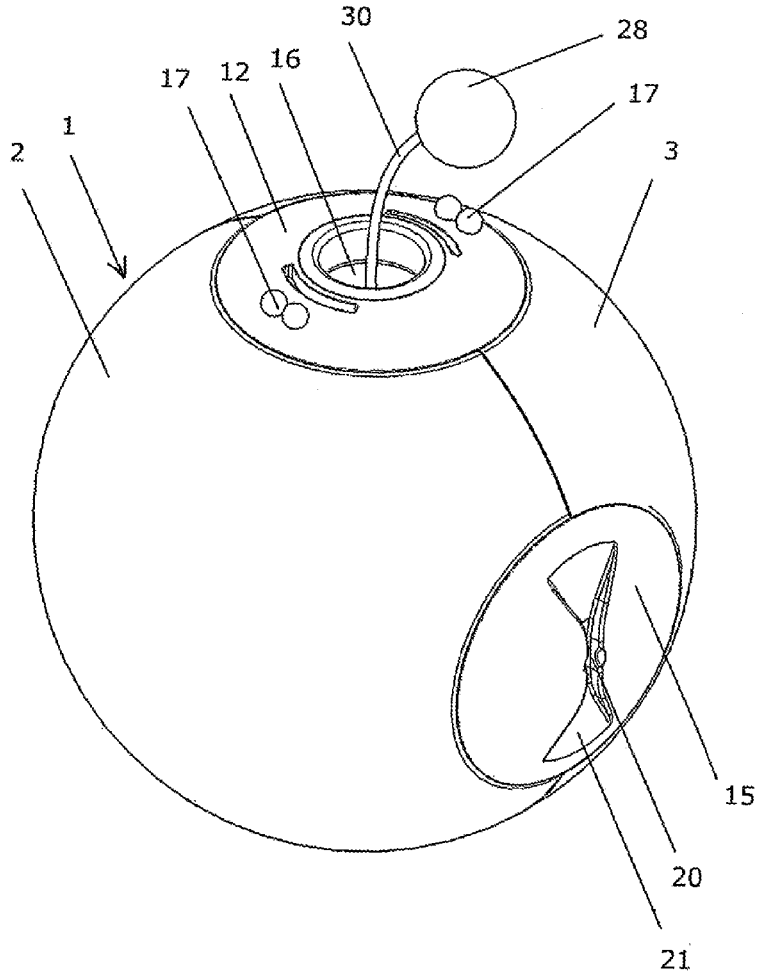
FIG. 1 shows a perspective view of one embodiment of the toy of the invention.
Figure 2:
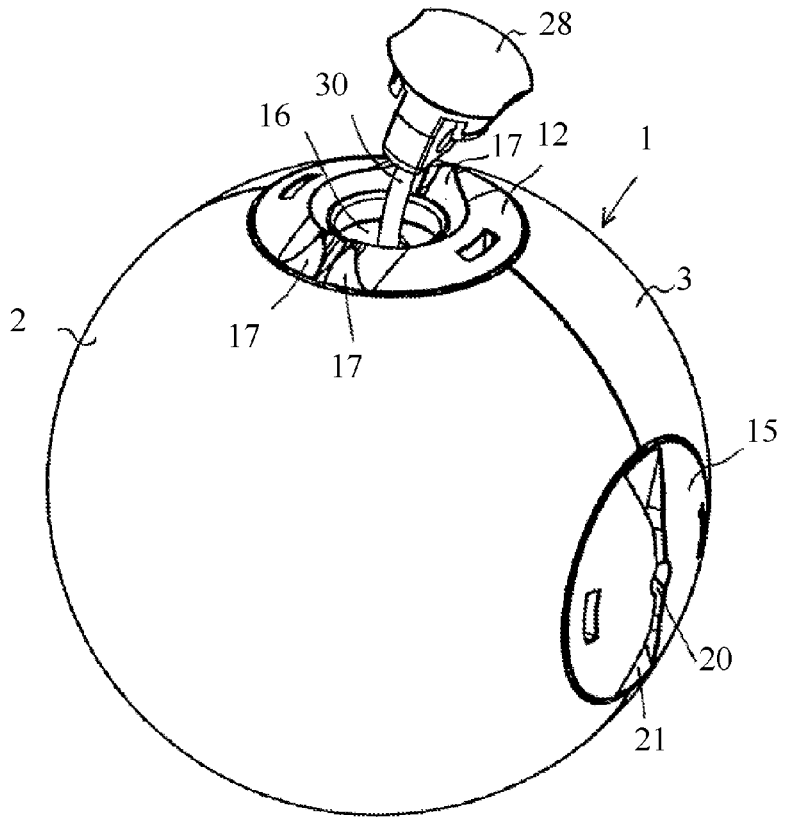
FIG. 2 shows a vertical sectional view of the toy from FIG. 1.

Reference is made first of all to FIGS. 1 and 2 as preferred examples, in which in each case a perspective view of the toy, denoted overall by 1, is shown, which toy is constructed according to the exemplary embodiments of the invention. According to FIG. 1, the yo-yo toy is provided with a holding element 28 at the end of the yo-yo string 30, which holding element is a holding ball, whereas the holding element 28 has a different form according to FIG. 2. The string 30 is connected in each case with its other end to the axle of the yo-yo is. According to the figures, the housing of the yo-yo toy is preferably spherical and, in the examples, is formed from the hemispheres 2 and 3, into which the yo-yo can be inserted with its axle, and which housing parts are held together by way of closure parts. In the example which is shown, these are pole-side (in relation to the ball), cap-shaped fastening parts, of which only the pole part 12 can be seen in FIG. 1 and FIG. 2. There is a further cap-shaped fastening or closure part on the underside of the ball, which fastening or closure part can be seen in other figures as pole part 13.

The embodiment of the yo-yo toy which is shown in the figures is suitable for being played using one hand, independently of left-handedness or right-handedness, with or without a finger loop, it being possible for the yo-yo to be set into the freewheeling operation and for the latter to be held. The toy can be balanced, spun and juggled during the yo-yo game. In order for it to be possible to fulfill all these purposes, a housing is provided around the yo-yo, which housing is substantially spherical in the embodiment which is shown. It is formed from the housing parts 2 and 3. The shape of the housing can be as desired or can be non-spherical. It is connected in part to the axle of the yo-yo, and is also not connected in part to the axle. In addition, the elements which are provided at the caps 12, 13, 14 and 15 and will still be explained assist the abovementioned purposes. Furthermore, the holding element 28 is constructed in such a way that playing without a finger loop is assisted, and that the string length can be set simply to the desired size.

Figure 3:
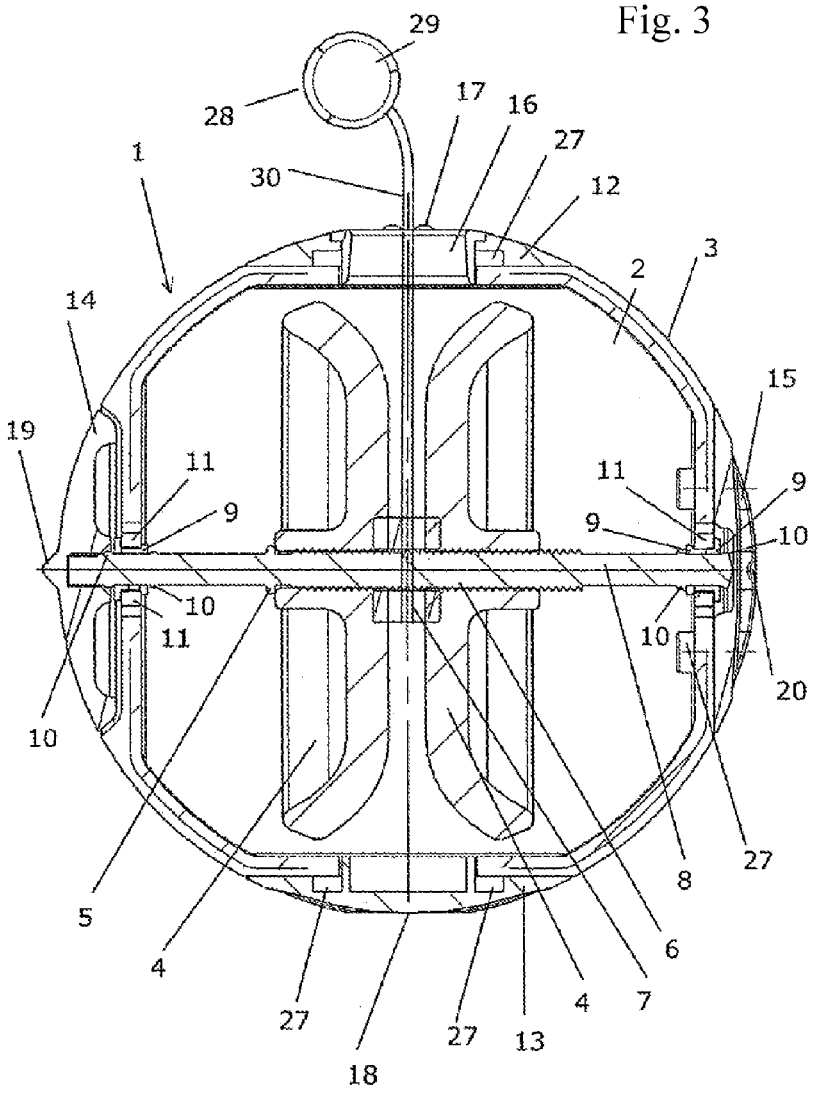
FIG. 3 shows a perspective view of a further embodiment of the toy.
Figure 4:
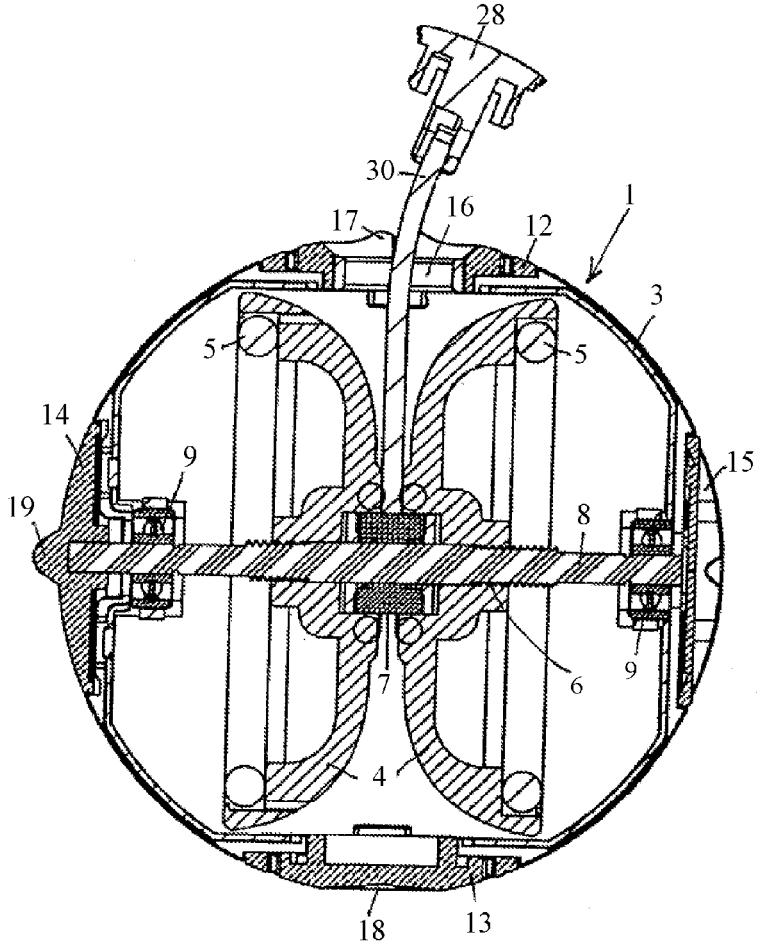
FIG. 4 shows a vertical sectional view of the toy from FIG. 3.

FIGS. 3 and 4 in each case show a vertical sectional view of the toy according to FIG. 1 or FIG. 2. Here, identical designations denote identical or functionally identical components in both embodiments. The two jaws 4 of the yo-yo, the stop 5 on the axle 8 of the yo-yo for centering the yo-yo jaws, or corresponding rings 5 in FIG. 4, the thread 6 for holding the jaws of the yo-yo, the ball bearing 7 and the axle 8 of the yo-yo can be be seen. In addition, the double-sided plain bearings or ball bearings 9 between the yo-yo axle 8 and the housing parts 2 and 3 can be seen, spacer elements 10 and mountings 11 being provided, furthermore, for mounting the axle 8 in the housing. Furthermore, the section through the caps 12, 13, 14 and 15 can be seen which serve for the closure of the housing parts 2, 3 by way of means which are known to a person skilled in the art, for example by means of pins 27 which engage into the hemispheres 2 and 3. However, the cap-shaped fastening means can also engage, for example, with an external thread into an internal thread which is formed in the receptacles for the cap-shaped fastening means in the ball halves. The closure of the housing and the fastening of the housing parts, in particular the housing halves, can also be achieved by way of a bayonet closure, a plug-in connection or other connection options.

At the same time, a perspective view of the holding element can be seen in FIG. 1 and FIG. 2 and a sectioned view of the holding element 28 with the structural principle for setting the string length can be seen in FIGS. 3 and 4. A storage space 29 for string can be provided in the holding element 28 from FIGS. 1 and 3, which string connects the holding ball to the axle of the yo-yo. The holding element of FIGS. 1 and 3 is preferably configured in such a way that it fits into the recess 16 of the cap or can be sunk into the latter, in particular in such a way that the holding element in the process comes to lie substantially flush with its surface against the surface of the housing or the cap, with the result that the spherical shape of the toy is maintained in a particularly satisfactory manner with a sunk holding element 28.

Figure 5:
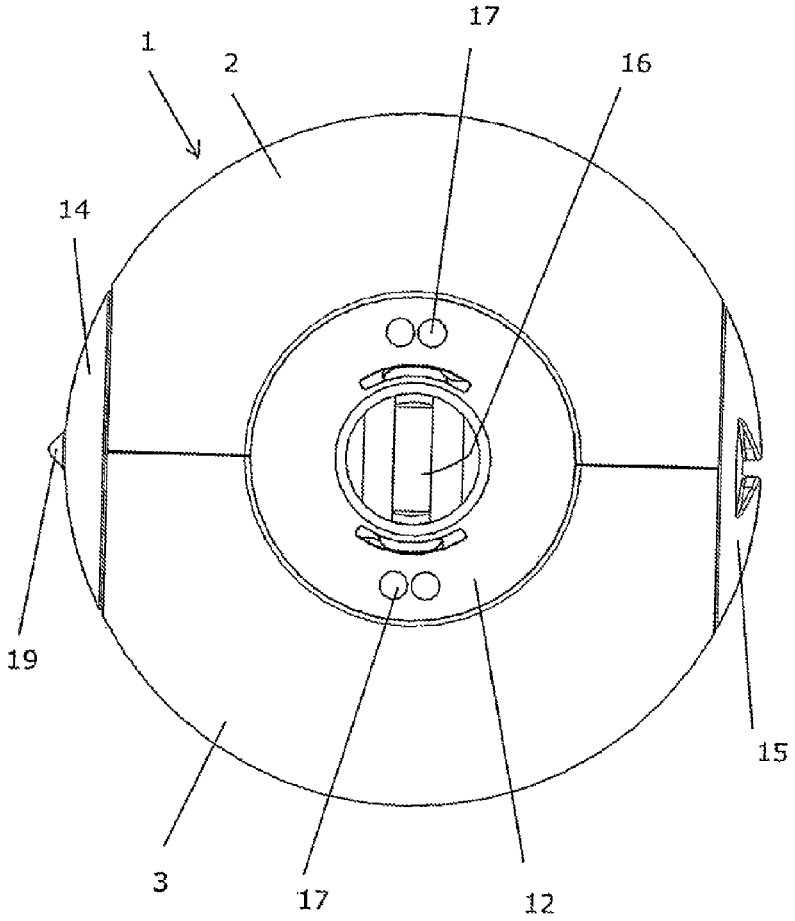
FIG. 5 shows a view of the toy according to FIG. 1 from above or the upper pole side.
Figure 6:
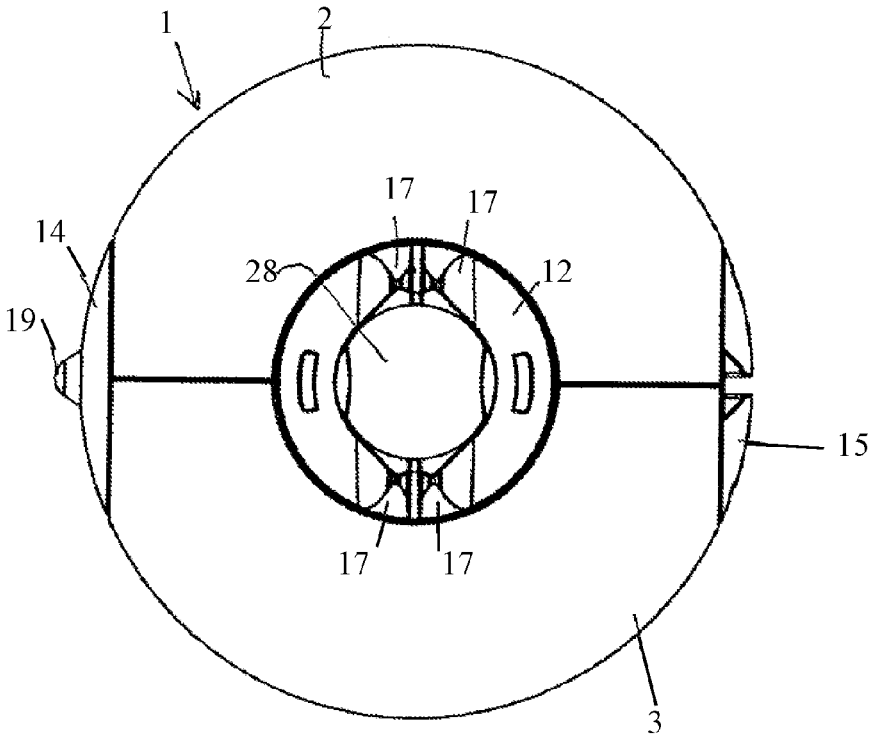
FIG. 6 shows a view of the toy according to FIG. 2 from above or the upper pole side.

FIGS. 5 and 6 show a view of the toy according to FIG. 1 and FIG. 2, respectively, from above and therefore of the upper pole of the ball, at which the cap 12 can be seen which has the outlet opening 16 for the string 30 and the fixing elements 17 for the string which fix the string during the freewheeling operation of the yo-yo. The outlet opening 16 is constructed in such a way that it lies in a centered manner above the center of the yo-yo, and that the string generates as little friction as possible when passing said opening. Furthermore, the outlet opening 16 helps to keep the yo-yo in balance more easily during play, since tilting away of the yo-yo is therefore made more difficult. The cap 12 is constructed in such a way that the outlet opening 16 and the fixing elements 17 are accommodated thereon, it also being possible for the fixing elements 17 to be constructed directly onto the ball halves 1 and 2. The fixing element or the fixing elements can also be formed by a depression or depressions which is/are made directly in the housing shell in the manner of a groove or a notch, with the result that no shaped-out formations extend beyond the housing shell and nevertheless the string section can be clamped into the depression and is therefore fixed.

The fixing elements preferably lie in each case arranged transversely with respect to the axle of the yo-yo. Two fixing elements are preferably arranged on both sides of the outlet opening 16.

The fixing elements shown in the figures for the string are constructed in such a way that the string, while the yo-yo is rotating in the freewheeling operation, can be fixed on one of said fixing elements rapidly and in such a way that the tension of the string with respect to the axle remains approximately identical and the freewheeling operation is therefore maintained, even if the string is no longer tensioned by way of the weight of the yo-yo. This construction makes it possible to spin, to balance, to juggle and to return directly again to actual yo-yo play with the toy, by the string being released from the fixing element 17. The fixing element is preferably constructed in such a way that this already takes place by means of a tugging movement upward on the string, that is to say, for example, if the holding element 28 is held and the housing of the toy is allowed to drop into the string. The string is therefore preferably fixed in the fixing element by way of clamping in between two shaped-out formations of the fixing element.

Figure 7:
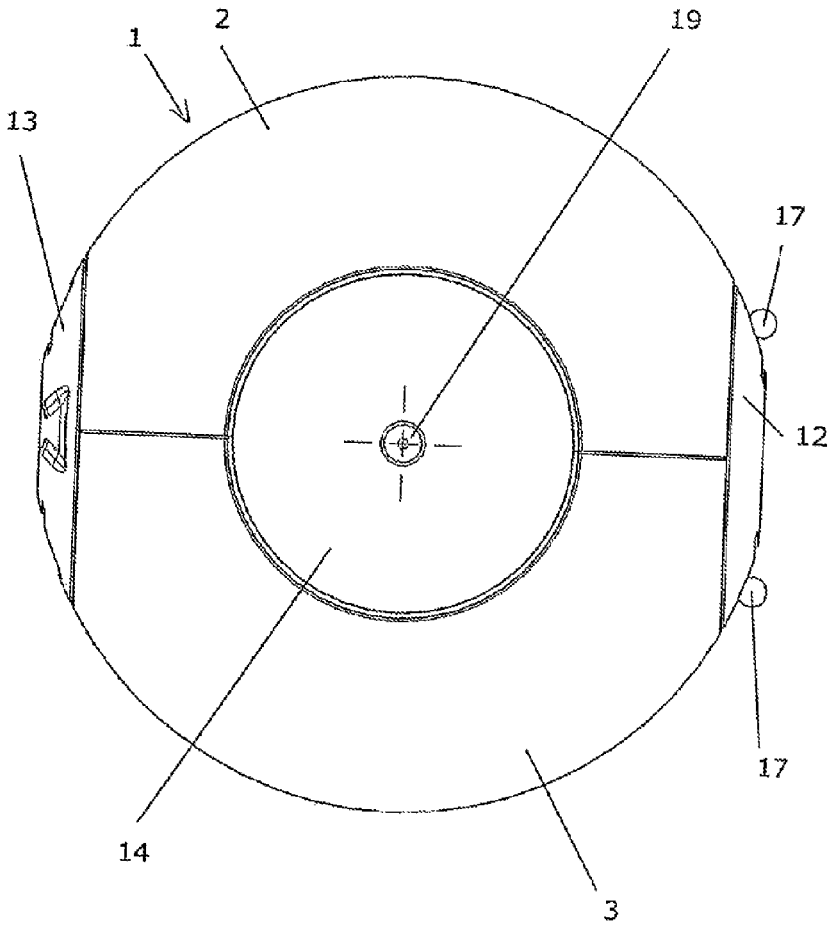
FIG. 7 shows a view of the toy according to FIG. 1 from the left-hand side.
Figure 8:
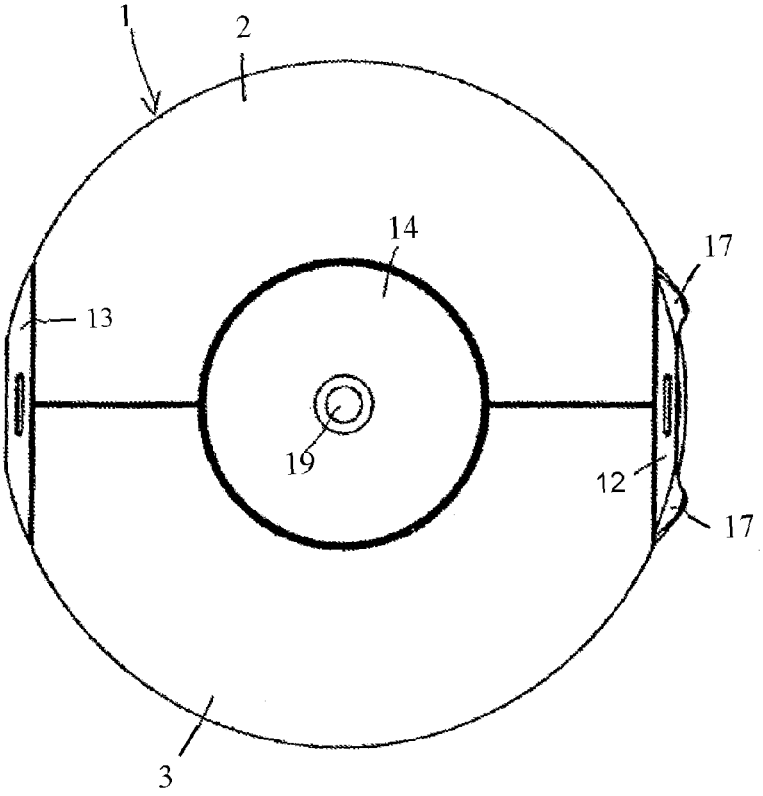
FIG. 8 shows a view of the toy according to FIG. 2 from the left-hand side.

FIGS. 7 and 8 in each case show a view of the toy from the left-hand side (left, right, top and bottom in each case in relation to the illustration of FIGS. 3 and 4) and from the side, on which the axle 8 is preferably connected to the cap-shaped fastening part 14, with the result that the axle 8 and the cap 14 rotate together, a shaped-out formation 19 being provided at the cap 14. The shaped-out formation is therefore arranged in such a way that it corotates with the yo-yo, with the result that spinning of the toy is possible on said shaped-out formation during the rotation of the axle 8. In addition, thanks to the cap which is connected in this way to the axle, the string can be wound onto the ball bearing 7 which is placed onto the axle or onto the yo-yo, by the cap 14, for example, being rotated in the winding-up direction using a finger.

Figure 9:
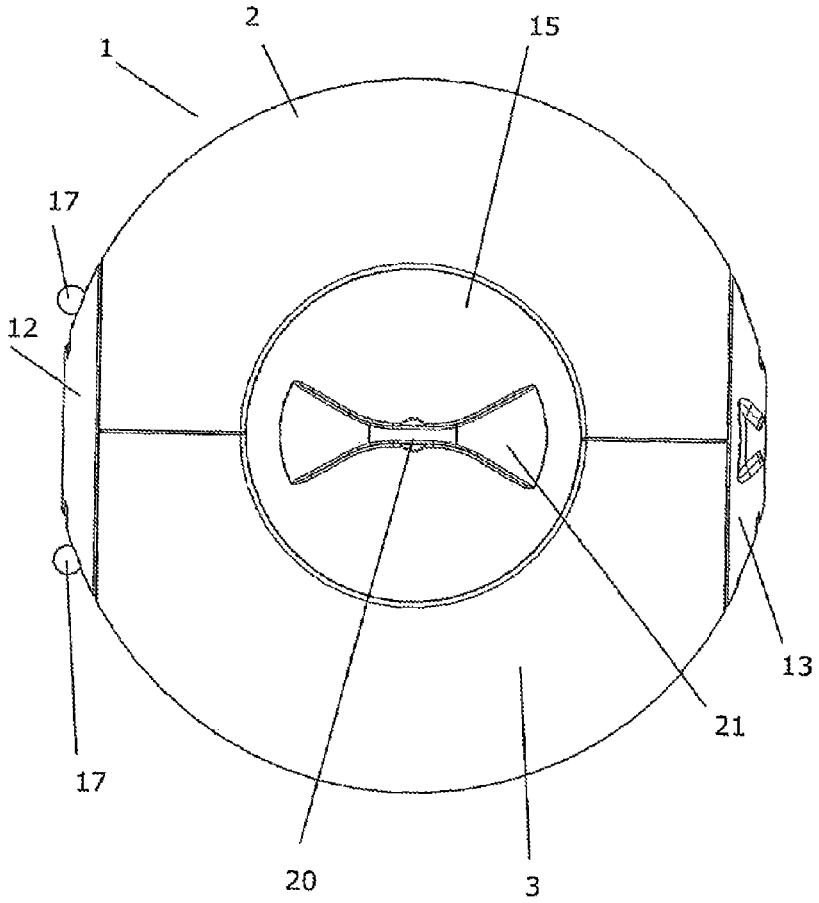
FIG. 9 shows a view of the toy according to FIG. 1 from the right-hand side.
Figure 10:
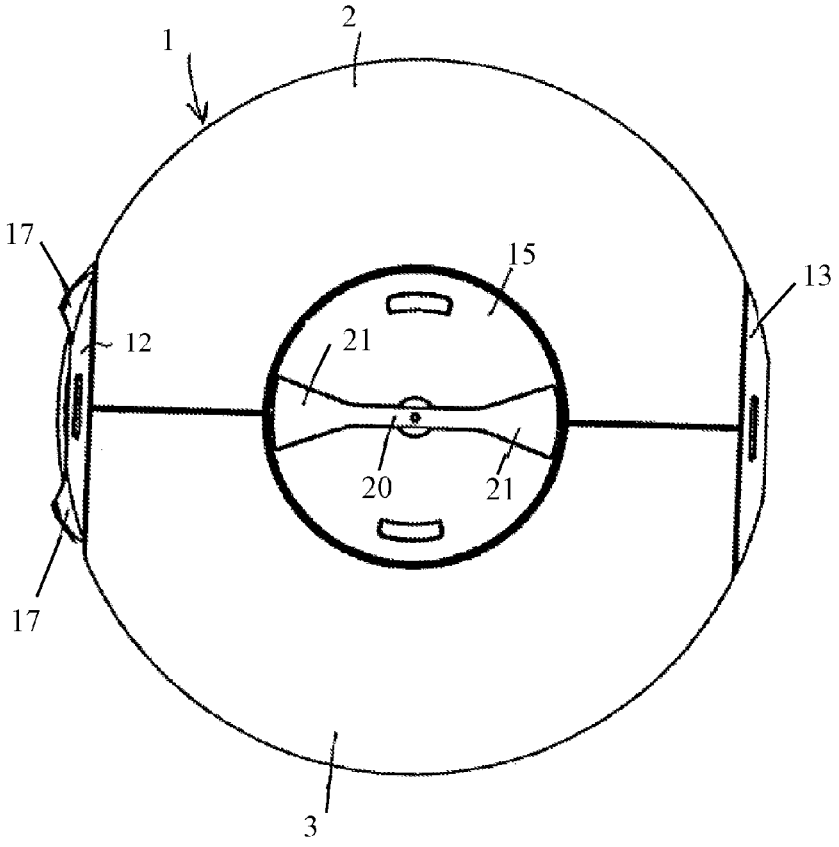
FIG. 10 shows a view of the toy according to FIG. 2 from the right-hand side.

FIGS. 9 and 10 in each case show a view of the toy from the right-hand side, that side at which the axle 8 is not connected to the cap 15. The string guide 21 which is provided on the cap 15 makes string tricks possible with the toy during and without the freewheeling operation of the yo-yo. In addition, the depression 20 which is provided facilitates balancing of the toy with objects and also, for example, with a finger, once again during and without the freewheeling operation of the yo-yo.

Figure 11:
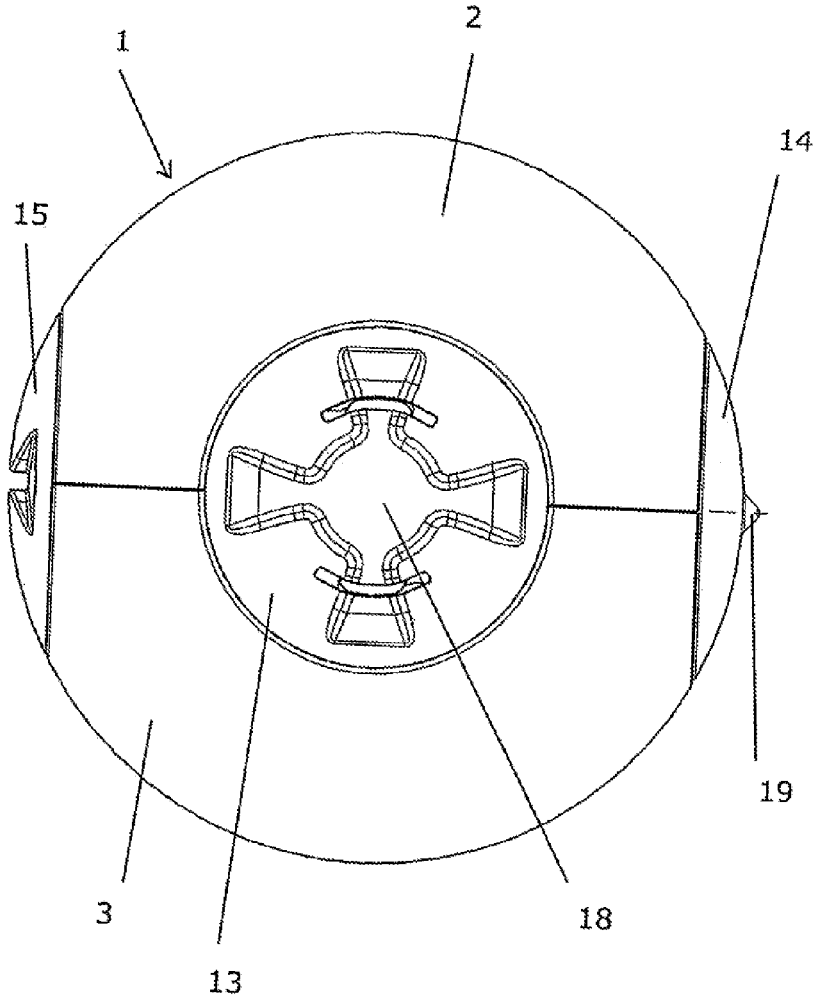
FIG. 11 shows a view of the toy according to FIG. 1 from below or the lower pole side.
Figure 12:
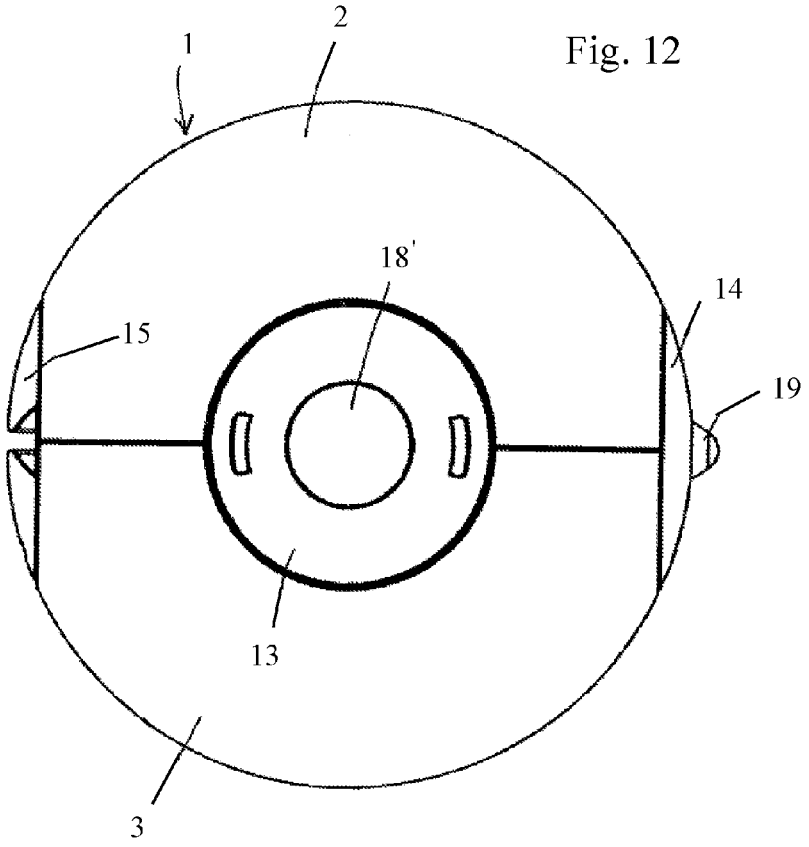
FIG. 12 shows a view of the toy according to FIG. 2 from below or the lower pole side.

FIGS. 11 and 12 in each case show a view of the toy from below, in which, in the embodiment according to FIG. 11 or in the toy according to FIG. 1, the cap 13 can be seen with one crossed string guide 18 which makes string tricks of the yo-yo possible during and without the freewheeling operation of the yo-yo. In the embodiment according to FIG. 12 or in the toy from FIG. 2, a surface 18' is provided which facilitates placing of the toy on a surface.

Figure 13:
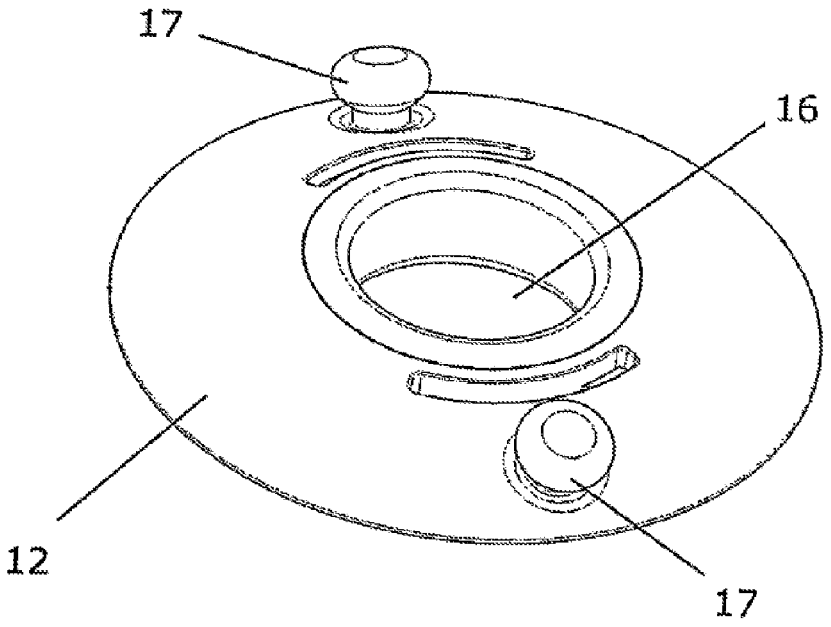
FIG. 13 shows a view of the upper cap with fixing elements which have in each case two bollard-shaped parts.

FIG. 13 is a view of the upper closure element or the upper cap 12 with bollard-shaped fixing elements 17, on which the string can be fastened and fixed by being wrapped around them.

Figure 14:
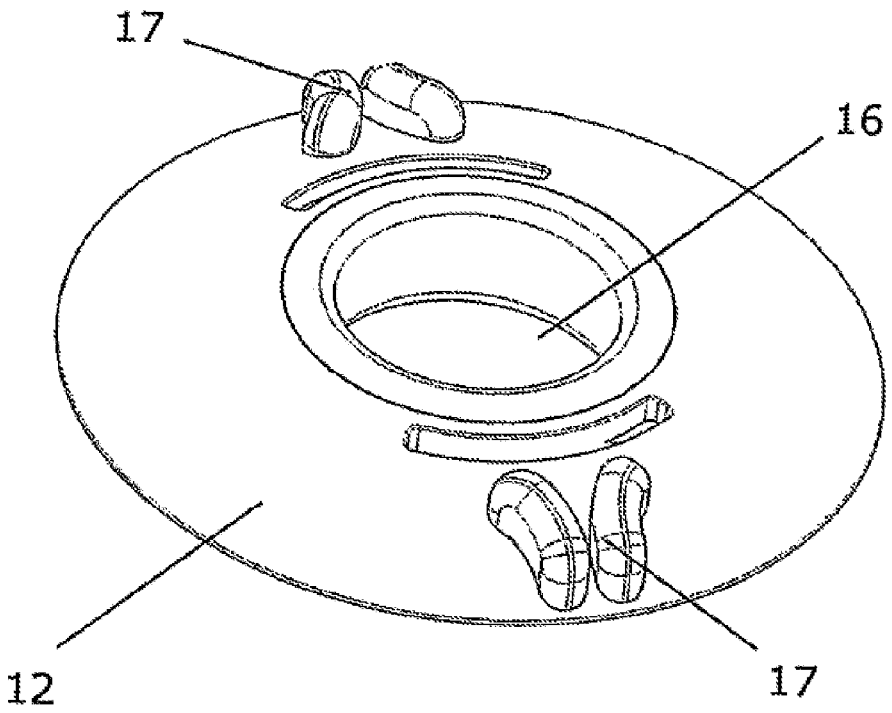
FIG. 14 shows a view of the upper cap with two fixing elements which in each case have a depression between two shaped-out formations.

FIG. 14 is a view of the upper closure element or the upper cap 12 with fixing elements 17 which in each case are provided with a depression between two shaped-out formations in which the string can be clamped. Said fixing elements also lie transversely with respect to the axle of the yo-yo, which is generally preferred.

Figure 15:
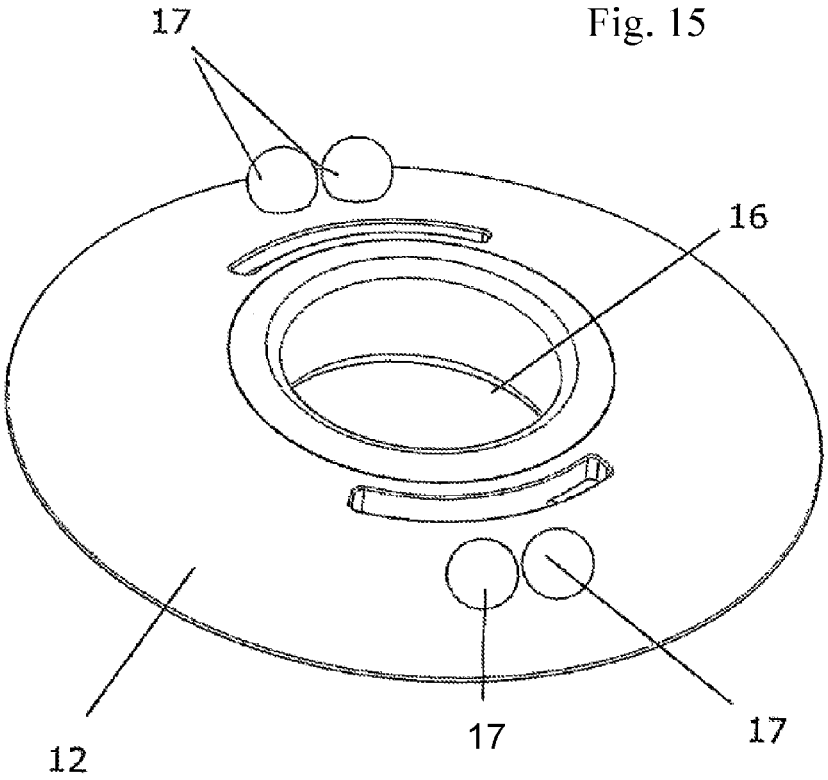
FIG. 15 shows a view with two fixing elements which in each case have a depression between two shaped-out formations, the shaped-out formations being spherical here.

FIG. 15 is a view of the upper closure element or the upper cap 12 with fixing elements 17 consisting of in each case two spherical shaped-out formations, between which the string can be clamped.

Figure 16:
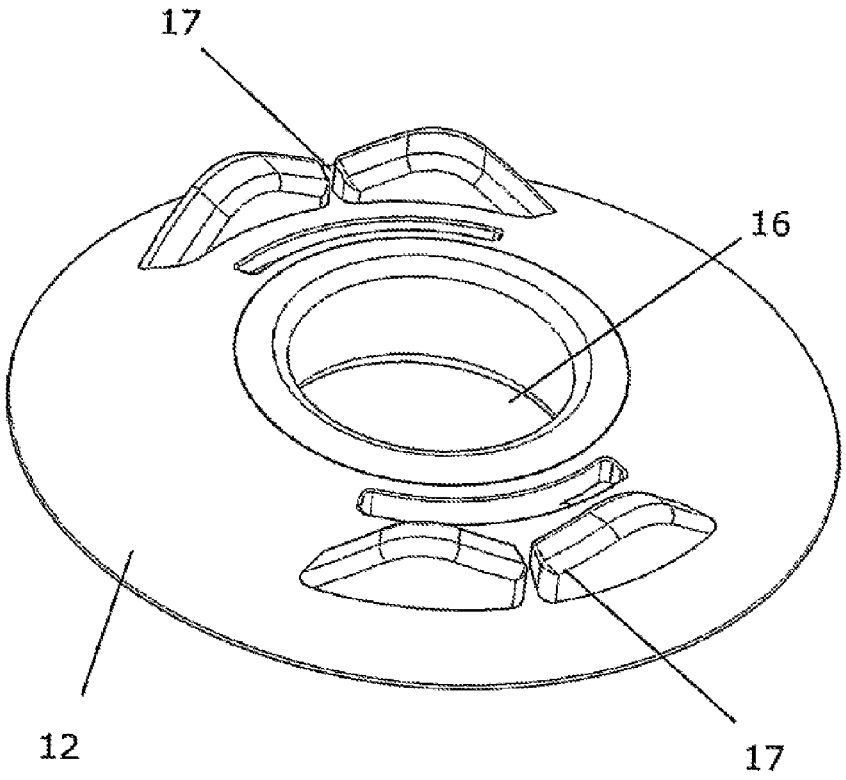
FIG. 16 shows a view with two further fixing elements which have in each case one depression between two shaped-out formations.

FIG. 16 is a view of the upper closure element or the upper cap 12 with fixing elements 17 with in each case one depression between two shaped-out formations which lie transversely with respect to the ball opening and taper inward.

Figure 17:
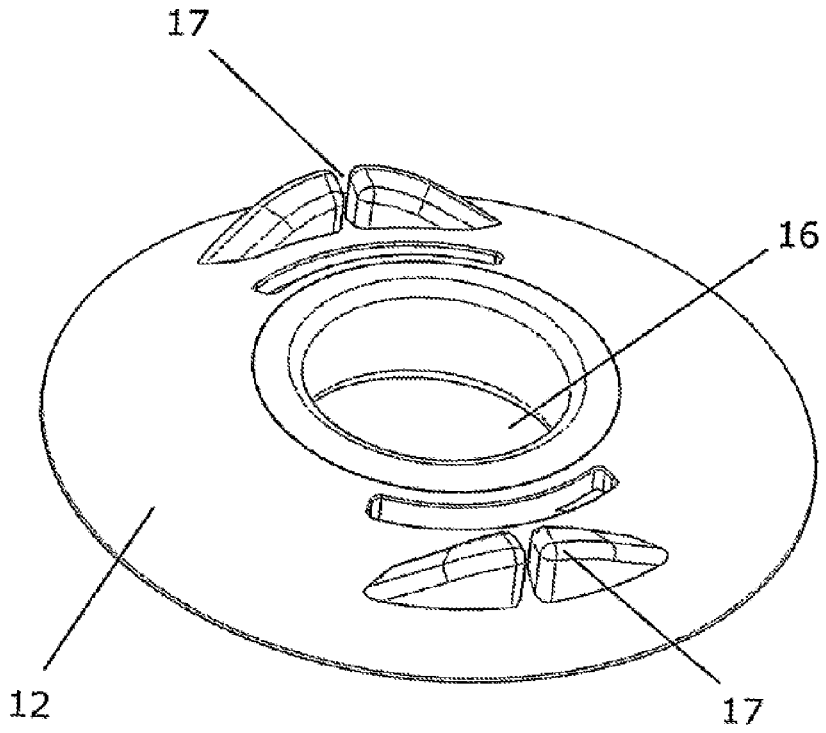
FIG. 17 shows a view with two fixing elements which in each case have a depression between two shaped-out formations which taper toward the outside.

FIG. 17 is a view of the upper closure element or the upper cap 12 with a depression between two shaped-out formations as fixing elements 17 which lie transversely with respect to the ball opening and taper toward the outside.

FIGS. 18 to 20 show a preferred cap 12, as is provided in the toy of FIG. 2. The fixing elements 17 are formed by shaped-out formations here again, in each case two shaped-out formations forming a groove between themselves, in which groove the string can be clamped, in order to fix it. The shaped-out formations are beveled toward the housing and are beveled toward the opening 16, which is preferred for the handling of the toy and, in particular, the string. It can be seen that angled-away projections 31 which interact with corresponding slots in the housing halves 2, 3 are provided on the underside of the cap, with the result that the cap 12 is inserted into the housing halves which bear against one another and is then fastened to them by way of rotation. To this end, the slots in the housing halves have a first wider part, into which the angled-away end of the projections fits, and subsequently a narrower part, into which only the web of the projections can engage when the cap is rotated.

The invention claimed is:

1. A yo-yo toy comprising:

a yo-yo with a freewheel and a housing which surrounds the yo-yo and in which an axle of the yo-yo is mounted, the housing having an outlet opening for the yo-yo string on its upper side, the housing having at least one fixing element on its upper side having a fixing element which is arranged substantially transversely with respect to the axle of the yo-yo and is arranged and configured in such a way that the yo-yo string can be fastened to the fixing element and can be released;

the housing having an outlet opening for the yo-yo string on its upper side, the housing having at least one fixing element on its upper side, having a fixing element which is arranged substantially transversely with respect to the axle of the yo-yo and is arranged and configured in such a way that the yo-yo string can be fastened to the fixing element and can be released;

wherein the fixing element is formed by a depression in the housing, into which depression a section of the string can be clamped, in particular in that the fixing element is formed by two adjacent shaped-out formations on the housing, which shaped-out formations form a depression between themselves, into which depression a section of the string can be clamped; and wherein the fixing element is formed by a bollard-shaped shaped-out formation, to which the string can be fastened by being wrapped around it.

2. The yo-yo toy as claimed in claim 1, wherein at least two fixing elements which are arranged on both sides of the outlet opening are provided.

3. The yo-yo toy as claimed in claim 1, wherein a holding element is arranged at the string end.

4. The yo-yo toy as claimed in claim 3, wherein the holding element is a holding ball, or in that the holding element is a holding element which can be sunk into the housing of the toy and, in the sunk state, comes to lie substantially flush with the housing surface.

5. The yo-yo toy as claimed in claim 3, further comprising a holding ball provided with a closure which can be opened and closed and has a storage space for a string section.

6. The yo-yo toy as claimed in claim 1, wherein the housing is substantially spherical and has an outlet opening for the yo-yo string, which outlet opening is arranged centrally on the ball upper side.

7. The yo-yo toy as claimed in claim 6, wherein the housing further comprises a pair of spaced apart cap-shaped closure parts providing bearing points of the axle.

8. The yo-yo toy as claimed in claim 7, wherein at least one of the cap-shaped closure parts is arranged so as to co-rotate with the axle during operation of the yo-yo toy.

9. The yo-yo toy as claimed in claim 8, wherein one of the co-rotating cap-shaped closure parts is provided with a central shaped-out formation.

10. The yo-yo toy as claimed in claim 7, wherein one of the co-rotating cap-shaped closure parts is provided with a central indentation.

11. A yo-yo toy comprising a yo-yo with a freewheel and a housing which surrounds the yo-yo and in which an axle of the yo-yo is mounted, the housing having an outlet opening for the yo-yo string on its upper side, the housing having at least one fixing element on its upper side, having a fixing element which is arranged substantially transversely with respect to the axle of the yo-yo and is arranged and configured in such a way that the yo-yo string can be fastened to the fixing element and can be released;

wherein the housing is substantially spherical and has an outlet opening for the yo-yo string, which outlet opening is arranged centrally on the ball upper side;

wherein the housing is formed substantially from two ball halves, and, in particular, in that the housing is divided vertically as viewed from the outlet opening; and wherein the housing is formed by two cap-shaped pole parts, one in the region of the outlet opening and the other in the region which lies opposite the outlet opening, which pole parts can be detached from the remaining housing, and one pole part in the outlet opening carries at least one fixing element.

12. The yo-yo toy as claimed in claim 11, wherein a string guide is provided in at least one of the cap-shaped closure parts.

13. The yo-yo toy as claimed in claim 11, wherein the housing further comprises a pair of spaced apart cap-shaped closure parts providing bearing points of the axle.

14. The yo-yo toy as claimed in claim 13, wherein at least one of the cap-shaped closure parts is arranged so as to co-rotate with the axle during operation of the yo-yo toy.

* * * * *